US006439613B2

(12) United States Patent
Klure

(10) Patent No.: US 6,439,613 B2
(45) **Date of Patent: *Aug. 27, 2002**

(54) MULTIPLE-COMPONENT DATA PACKAGE

(75) Inventor: Brian Klure, Portland, OR (US)

(73) Assignee: Western Graphics and Data, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/925,858

(22) Filed: Aug. 9, 2001

Related U.S. Application Data

(63) Continuation of application No. 09/839,801, filed on Apr. 19, 2001, now Pat. No. 6,328,341, which is a continuation-in-part of application No. 09/520,646, filed on Mar. 7, 2000, now Pat. No. 6,224,108.

(51) Int. Cl.[7] ..... B42D 15/00

(52) U.S. Cl. ..... 283/62; 283/61; 283/74; 283/904; 206/454; 235/380

(58) Field of Search ..... 283/61, 62, 904, 283/74; 281/2, 5; 235/380; 206/38, 39, 782, 454

(56) References Cited

U.S. PATENT DOCUMENTS

| | | | | |
|---|---|---|---|---|
| 3,759,179 | A | 9/1973 | Guido | 101/368 |
| 4,765,656 | A | 8/1988 | Becker et al. | 283/70 |
| 4,978,146 | A | 12/1990 | Warther et al. | 283/81 |
| 5,494,544 | A | 2/1996 | Hill et al. | 156/64 |
| 5,495,981 | A | 3/1996 | Warther | 229/71 |
| 5,506,395 | A | 4/1996 | Eppley | 235/486 |
| 5,629,977 | A | 5/1997 | Fonseca | 379/144 |
| 5,640,447 | A | 6/1997 | Fonseca | 379/144 |
| 5,650,209 | A | 7/1997 | Ramsburg et al. | 428/43 |
| 5,667,247 | A | 9/1997 | Ramsburg et al. | 283/61 |
| 5,684,291 | A | 11/1997 | Taskett | 235/487 |
| 5,735,550 | A | 4/1998 | Hinkle | 283/108 |
| 5,740,915 | A | 4/1998 | Williams | 206/555 |
| 5,746,451 | A | 5/1998 | Weyer | 283/65 |
| 5,760,381 | A | 6/1998 | Stich et al. | 235/380 |
| 5,777,305 | A | 7/1998 | Smith et al. | 235/380 |
| 5,839,763 | A | 11/1998 | McCannel | 283/109 |
| 5,844,230 | A | 12/1998 | Lalonde | 235/487 |
| D411,765 | S | 7/1999 | Holihan | D3/247 |
| 5,918,909 | A | 7/1999 | Fiala et al. | 283/61 |
| 5,921,584 | A | 7/1999 | Goade, Sr. | 283/107 |
| 6,217,078 | B1 * | 4/2001 | Roth et al. | 283/62 |
| 6,224,108 | B1 | 5/2001 | Klure | 283/74 |

* cited by examiner

*Primary Examiner*—William Fridie, Jr.
(74) *Attorney, Agent, or Firm*—Chernoff, Vilhauer, McClung & Stenzel

(57) ABSTRACT

A data package assembly includes at least one data card having a first substrate with opposite faces, and indicia correlated with a prepaid account. A package has a second substrate separate from the first substrate, the data card being detachably connected to the second substrate. Personal identifying indicia correlated with the account are concealed by the package. In addition, first account verification indicia on the card, and second account verification indicia on the package, both different from the personal identifying indicia and both correlated with the same account, are visibly exposed, the package including an aperture visibly exposing the first account verification indicia.

6 Claims, 5 Drawing Sheets

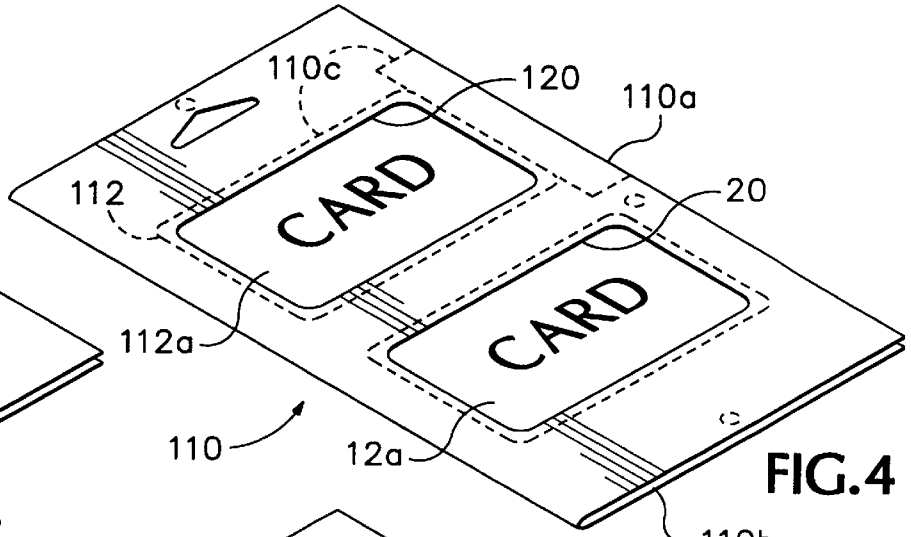
FIG.1
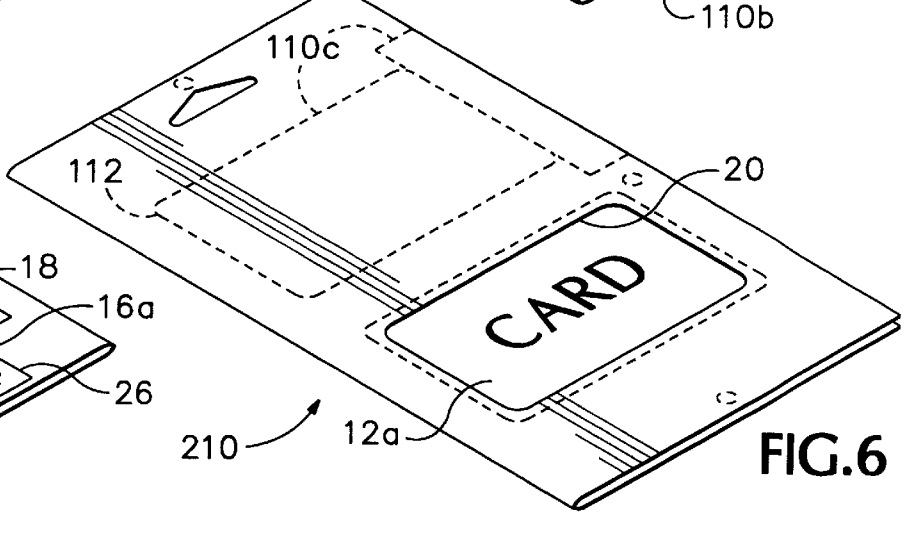
FIG.2
FIG.4
FIG.6

MULTIPLE-COMPONENT DATA PACKAGE

This is a continuation of U.S. patent application Ser. No. 09/839,801, filed Apr. 19, 2001, now U.S. Pat. No. 6,328,341, which is a continuation-in-part of U.S. patent application Ser. No. 09/520,646, filed Mar. 7, 2000, now U.S. Pat. No. 6,224,108, which is incorporated herein by reference.

BACKGROUND OF THE INVENTION

The present invention relates to improvements in a data package assembly, especially applicable to various types of prepaid debit cards associated with a prepaid account. The account is debited as the consumer uses the account to purchase services such as telephone services, or purchase goods, withdraw cash, etc.

In the past there have been two different basic types of structures for packaged data card assemblies. A first type is exemplified by U.S. Pat. Nos. 5,760,381 and 5,918,909, which are hereby incorporated by reference. In this type of assembly, the data card and the package, respectively, are separately manufactured from different substrates, and thereafter detachably interconnected in such a way that personal identifying indicia (e.g. a PIN number) on the card is concealed by the package. Account activation indicia, also on the card in the form of a magnetic strip or bar code, is exposed by the package so that the prepaid account can be activated at the cash register when the packaged card assembly is purchased. The problem with this type of packaged assembly is the combination of the personal identifying indicia and the activation indicia on the same card. Such small cards can easily be stolen from a store by removing the cards from their larger packages, and can then be resold either after illegal activation of the prepaid accounts or after deceiving buyers into believing that the accounts have been activated.

The second basic type of prior packaged card assembly is one wherein the card and the package have been manufactured jointly from the same substrate, with a perforated or die cut line providing easy detachment of the card from the package. In such case the personal identifying indicia is on the card in a location concealed by the package, while the account activation indicia is on the package in an exposed location for activation of the prepaid account at the cash register. This type of assembly does not encourage a thief to remove the card from the larger package, but produces a card of relatively low durability commensurate with that of the package. Solutions to this latter problem have been attempted, as exemplified by U.S. Pat. No. 5,650,209 which is hereby incorporated by reference, wherein the card portion of the common substrate of a card/package combination is laminated in plastic to improve its durability. However the resultant durability does not approach that obtainable by manufacturing the card separately from the package.

When the prepaid account is not of the activatable type, the presence of personal identifying indicia on the card is especially conducive to theft, or unauthorized use of a lost card. For this reason some previous packages, especially those having prepaid debit cards not requiring activation, exclude the personal identifying indicia from the card and instead include such indicia on a separate item concealed within the package. However, this creates a significant manufacturing drawback because of the need to match the card with the separate personal identifying indicia.

BRIEF SUMMARY OF THE INVENTION

The present invention overcomes the drawbacks of the above-described prior packaged card assemblies by providing a unique new basic type of assembly.

According to one preferred aspect of the invention, a data package assembly includes at least one data card having a first substrate with opposite faces, and indicia correlated with a prepaid account. A package has a second substrate separate from the first substrate, the data card being detachably connected to the second substrate. Personal identifying indicia correlated with the account are concealed by the package. In addition, first account verification indicia on the card, and second account verification indicia on the package, both different from the personal identifying indicia and both correlated with the same account, are visibly exposed, the package including an aperture visibly exposing the first account verification indicia.

In another preferred aspect of the invention, the package has the personal identifying indicia separate from the data card, preferably on a detachable portion of the second substrate.

The foregoing and other objectives, features, and advantages of the invention will be more readily understood upon consideration of the following detailed description, taken in conjunction with the accompanying drawings.

BRIEF DESCRIPTION OF THE DRAWINGS

FIG. 1 is a front perspective view of an exemplary data package assembly of the hanging type in accordance with the present invention, having a single data card sandwiched between a pair of panels.

FIG. 2 is a rear perspective view of the assembly of FIG. 1.

FIG. 4 is a front perspective view of a further exemplary embodiment of a hanging type of assembly in accordance with the present invention, including a pair of data cards.

FIG. 6 is a front perspective view of a further embodiment similar to FIG. 4, except that the second data card is not exposed.

DETAILED DESCRIPTION OF THE PREFERRED EMBODIMENTS

In all of the different exemplary embodiments described hereafter, the substrate from which at least one data card is constructed is separate from the substrate from which the corresponding package is constructed. Although the separate substrates may include identical material, the substrate of the card is preferably significantly more durable than the substrate of the package, for example, a card substrate of plastic versus a package substrate of stiff paper.

In all of the exemplary embodiments, the various indicia imaged on the respective substrates of the data card and package, including personal identifying indicia, activation indicia, and account verification indicia, can include human-readable characters or, alternatively, machine-readable indicia such as magnetic strip, bar code, etc. Respective indicia correlated with a particular account can be identical indicia or different indicia, as desired. Such account can be activated upon initial purchase of the corresponding card and, if desired, also upon subsequent replenishment of the account. Alternatively, the account might not be activatable.

In all of the exemplary embodiments, the means by which a card is detachably connected to a panel of a package can be by well-known means such as the use of appropriate adhesives, slits, pockets, enclosures, rivets, stickers, etc. either with or without tamper-revealing structures. Likewise the methods of making the card and the package, respectively, can be by any well-known means, as exemplified by the prior patents mentioned above which are incorporated herein by reference.

Subject to the foregoing variations, some exemplary embodiments are described more specifically hereafter.

Figures 3, 7:
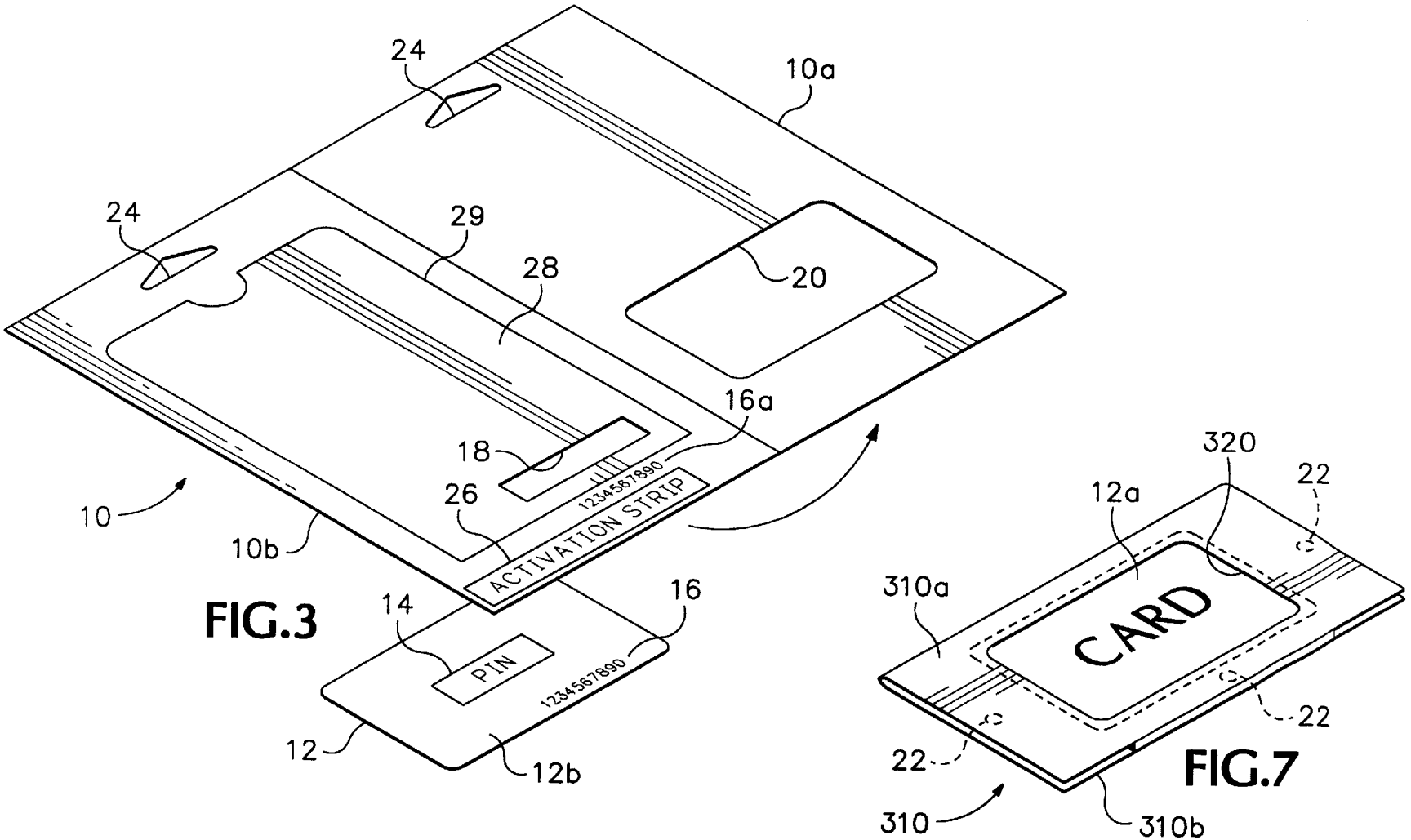
FIG. 3 is an unfolded, exploded perspective view of the assembly of FIGS. 1 and 2.
FIG. 7 is a front perspective view of an exemplary embodiment of a smaller data package assembly in accordance with the present invention for storage in a cash drawer.

In the embodiment 10 of FIGS. 1–3, the package is composed of a front panel 10*a* and a rear panel 10*b* of relatively stiff paper, folded together so as to sandwich a plastic data card 12 having a front face 12*a* and a rear face 12*b*. The rear face 12*b* contains personal identifying indicia 14 (e.g., a PIN) and account verification indicia 16 different from the personal identifying indicia 14 but both correlated with the same prepaid account. The front face 12*a* of the card contains attractive pictorial or photographic artwork and other information designed to attract purchasers. The rear face 12*b* of the card is detachably adhered to the interior surface of the rear panel 10*b* of the package so that the personal identifying indicia 14 are concealed by the rear panel 10*b*. An aperture 18 in the rear panel 10*b* is preferably provided to visibly expose the account verification indicia 16 on the rear surface 12*b*, but not the personal identifying indicia 14. The front panel 10*a* of the package preferably has a much larger aperture 20 formed therein visibly exposing a major portion of the front face 12*a* of the card 12. The front and rear panels 10*a* and 10*b*, respectively, of the package are held together in folded relationship preferably by adhesive applications such as 22. Both of the panels also have apertures 24 which align when the panels are folded to enable the package to be hung for retail display.

The rear panel 10*b* of the package contains activation indicia 26 in an exposed location, the indicia 26 preferably being a magnetically or optically coded strip correlated with the prepaid account associated with the personal identifying indicia 14 and the account verification indicia 16 on the rear face 12*b* of the card 12. The exposed activation indicia 26 on the package is quickly machine readable at the cash register to activate the prepaid account. Alternatively, if desired, the activation indicia 26 could be on the front panel 10*a* of the package.

Also on the rear panel 10*b* of the package, so as to be simultaneously readable with the account verification indicia 16 exposed through the aperture 18, is further account verification indicia 16*a* likewise different from the personal identifying indicia 14 and also correlated with the same prepaid account. The simultaneously readable account verification indicia 16, 16*a* enable confirmation that the personal identifying indicia 14 on the card 12 and the activation indicia 26 on the package are both correlated with the same prepaid account. This confirms to the manufacturer, card sponsor, and/or purchaser, as the case may be, that no mismatching of the separately manufactured card 12 and package, respectively, has occurred during the packaging process.

To enable easy opening of the package upon purchase, the rear panel 10*b* includes a flap 28 detachably separable along a perforated or die cut periphery 29 from the remainder of the panel 10*b*. The card 12 is detachably adhered to the flap 28 so that, with the flap detached, the card becomes accessible for easy detachment from the flap.

Figure 5:
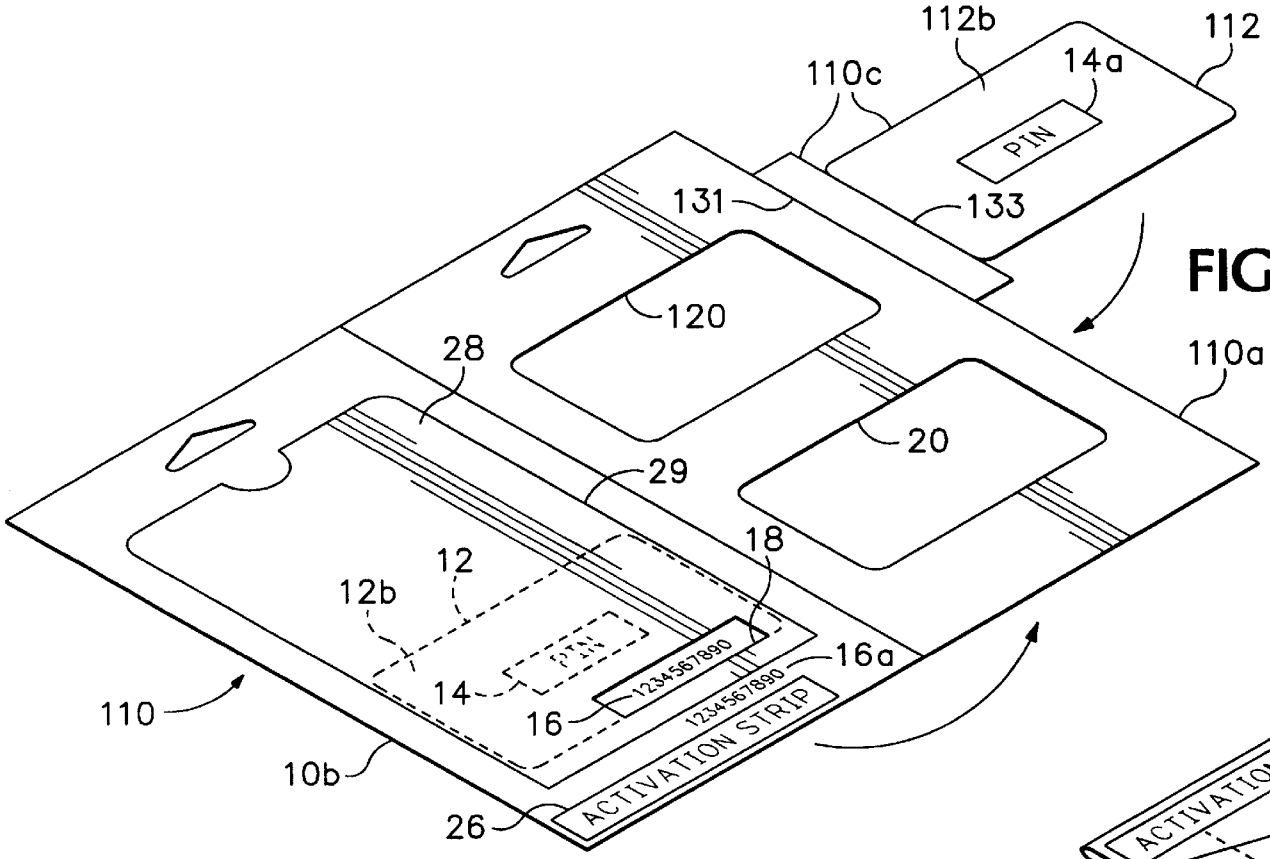
FIG. 5 is an unfolded perspective view of the embodiment of FIG. 4.

With reference to FIGS. 4 and 5, an alternative embodiment 110 of the data package assembly utilizes the same card 12 described previously. The package includes a rear panel 10*b* which is identical to rear panel 10*b* of the previous embodiment. However the front panel 110*a* has a smaller third panel 110*c* foldably attached thereto along a fold line 131 and including a second data card 112 (for example a bonus card) detachably connected to the remainder of the panel 110*c* by a perforated or die cut line 133. The card 112 has personal identifying indicia 14*a* thereon correlated with the same prepaid account as the personal identifying indicia 14 on the card 12. The second data card 112, however, is intended for only short-term use as compared to the card 12, and therefore can be constructed from the same substrate as that of the package since a high degree of durability is not needed. Moreover, the personal identifying indicia 14*a* on the card 112 are preferably different from the personal identifying indicia 14 on the card 12, even though correlated with the same prepaid account activated by the activation indicia 26, because the card 112 is intended to be capable of utilizing only a small portion of the resources in the account, as compared to the card 12.

The front panel 110*a* has a large aperture 20 for exposing the front face of the card 12 as in the previous embodiment, and also has an additional large aperture 120 for similarly exposing the front face 112*a* of the card 112 when the card 112 is folded beneath the front panel 110*a* as shown in FIG. 4. In such folded condition, the rear face 112*b* of the card 112, and thus its personal identifying indicia 14*a*, will likewise be concealed by the rear panel 110*b* of the package. Other than as noted, the embodiment of FIGS. 4 and 5 is similar to that of FIGS. 1–3.

The further alternative embodiment 210 of FIG. 6 is the same as that of FIGS. 4 and 5 except that the second large aperture 120 is deleted from the front panel.

Figure 8:
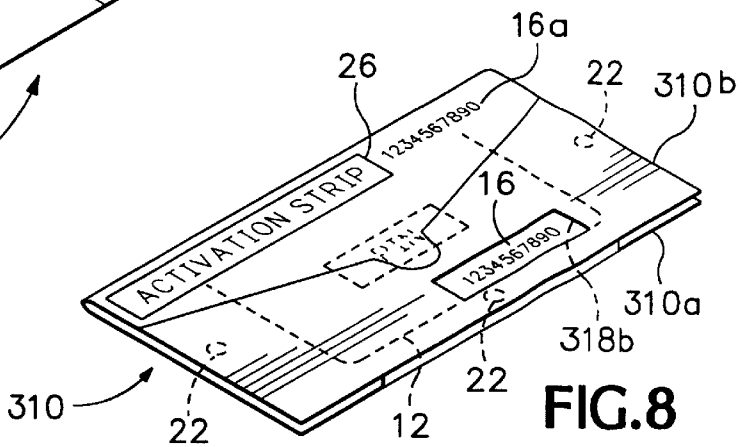
FIG. 8 is a rear perspective view of the assembly of FIG. 7.
Figure 9:
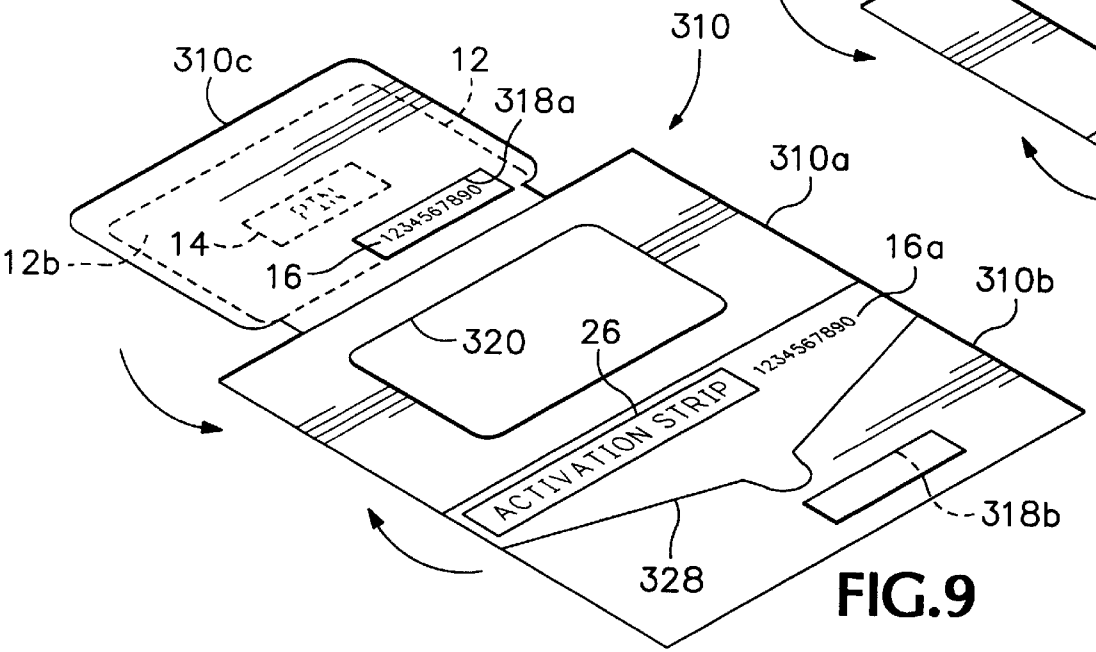
FIG. 9 is an unfolded perspective view of the assembly of FIGS. 7 and 8.

A further alternative embodiment of FIGS. 7–9 includes a data package assembly 310 utilizing the same data card 12 utilized by the previous embodiments. The package, however, is smaller for convenient storage in a cash drawer, and includes a front panel 310*a*, a rear panel 310*b*, and a smaller intermediate panel 310*c*. The rear face 12*b* of the card 12 is detachably adhered to the underside of the panel 310*c* as shown in FIG. 9 so that the personal identifying indicia 14 is concealed by the panel 310*c*, while the account verification indicia 16 is exposed through an aperture 318*a* in the panel 310*c*. The panel 310*c* is then folded beneath the panel 310*a* as shown in FIG. 9 so that a major portion of the front face 12*a* of the card 12 is exposed through the large aperture 320 in panel 310*a*. Then the panel 310*b* is folded beneath panel 310*c* and the assembly is secured in its folded configuration by adhesive 22, with aperture 318*b* in panel 310*b* aligned with aperture 318*a* so that the account verification indicia 16 remains exposed as shown in FIG. 8. The activation indicia 26 and second account verification indicia 16*a* are on the outside of the panel 310*b* so that the activation indicia can be read by machine at the cash register. The account verification indicia 16*a* is readable simultaneously with the account verification indicia 16 on the card 12, as shown in FIG. 8. Access to the card 12 upon purchase is through a detachable flap 328 in the panel 310*b*, similar to the flap 28 in the panel 10*b* of the previous embodiments.

Figure 10:
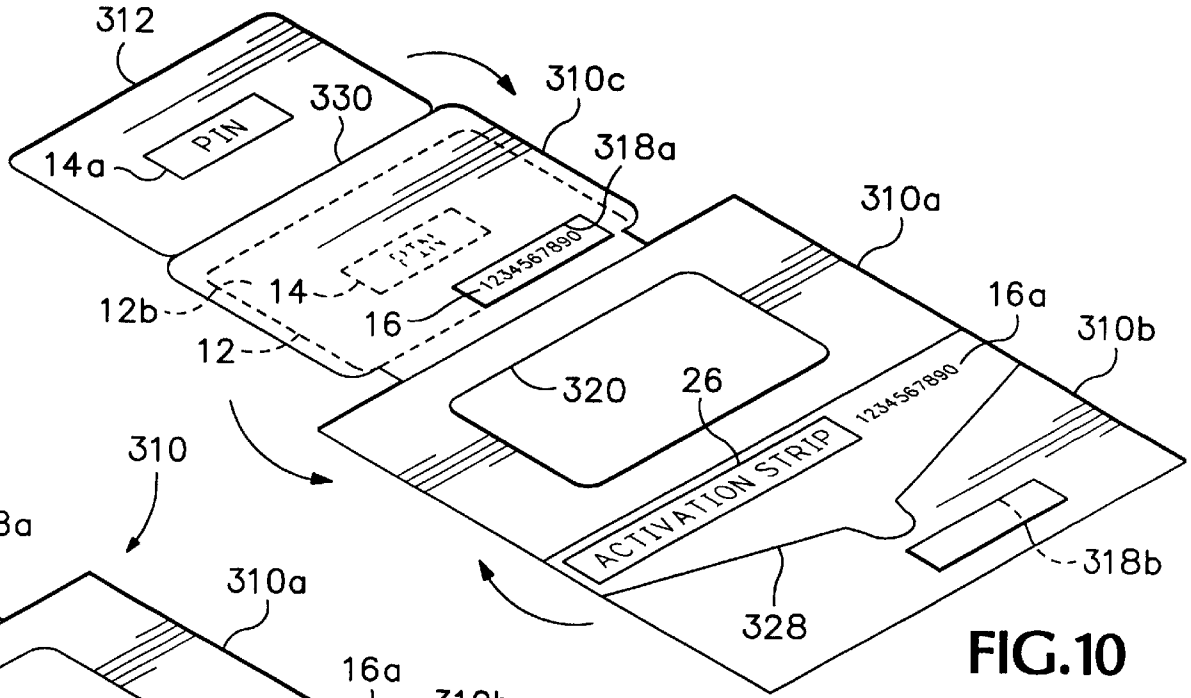
FIG. 10 is an unfolded perspective view similar to FIG. 9, but showing a different embodiment which includes a pair of data cards.

FIG. 10 shows an alternative to the embodiment of FIGS. 7–9 which includes a second data card 312, such as a bonus card, with personal identifying indicia 14*a* different from indicia 14 on the card 12. The additional card 312 shares the same substrate as the remainder of the package and is detachable from the panel 310*c* along a perforated or die cut line 330. The package is folded by folding the additional card 312 on top of the panel 310*c* as seen in FIG. 10, and then further folding the package as described with respect to FIG. 9. The additional card 312 is not as wide as the panel 310*c* so that, when the card 312 is folded on top of the panel 310*c*, it does not conceal the account verification indicia 16 on the card 12.

Figure 11:
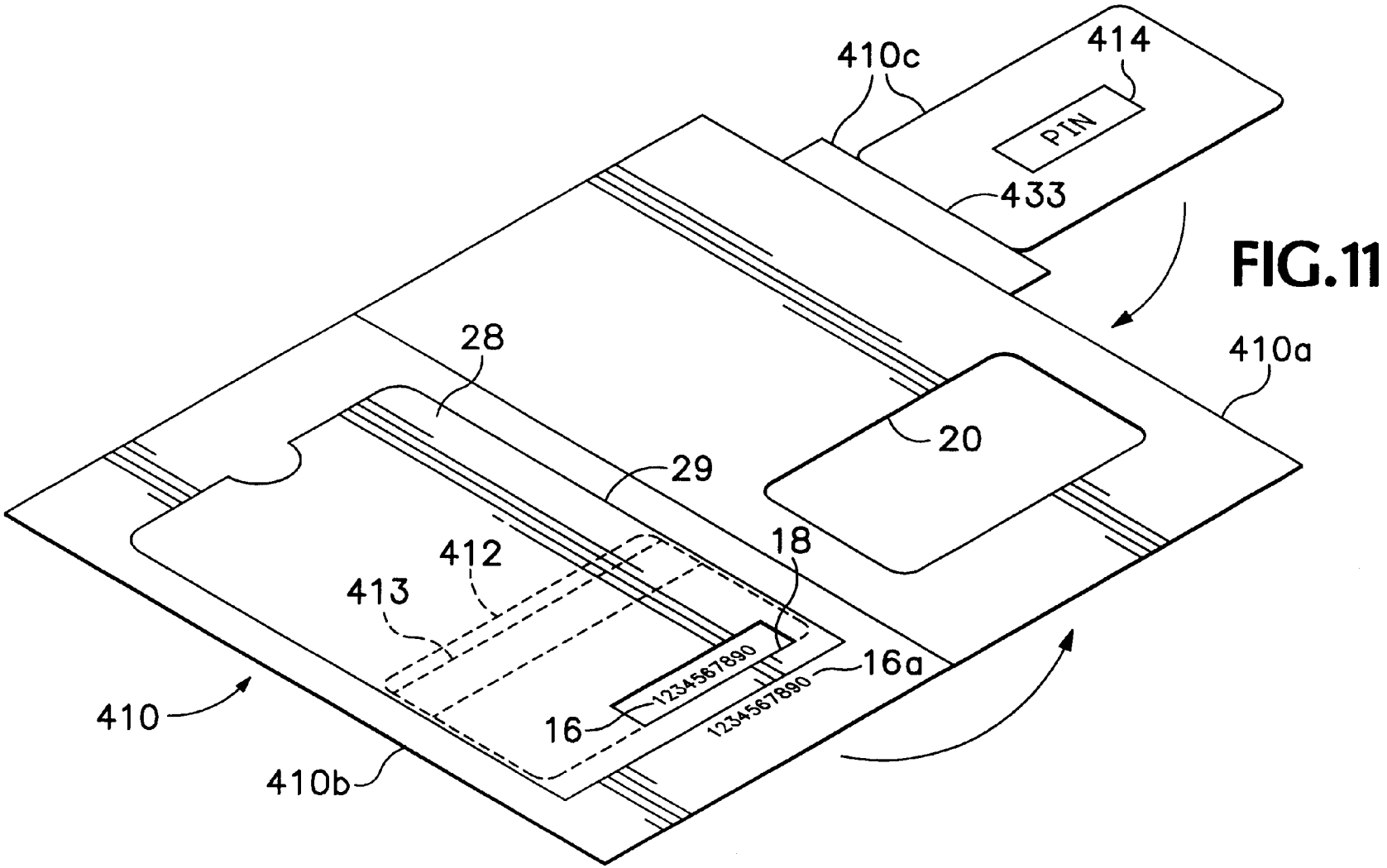
FIG. 11 is an unfolded perspective view of a further exemplary embodiment having an unactivatable data card and personal identifying indicia separate from the card.

With reference to FIG. 11, a further alternative embodiment 410 of the data package assembly utilizes a detachable card 412 similar to the card 12 described previously, except that it contains no personal identifying indicia 14. The exemplary card 412 can be for use in an ATM machine, or as a gift card for obtaining products at a cash register, or as some other kind of stored value card. Preferably, the card 412 has indicia thereon, in the form of a data-encoded magnetic strip 413 and/or a visually readable number, or both, correlated with a prepaid account. The package includes a front panel 410*a*, a rear panel 410*b* and a smaller third panel 410*c* formed from a single substrate. These panels are structurally similar to the panels of the embodiment of FIG. 6 except that the rear panel 410*b* has no activation indicia 26 (although such indicia could optionally be included), and the third panel 410*c* contains personal identifying indicia 414 for accessing the prepaid account identified by the card 412. The card portion of the panel 410*c* bearing the personal identifying indicia 414 is preferably detachably connected to the remainder of the panel 410*c* by a perforated or die cut line 433 so that the user may conveniently keep the personal identifying indicia 414 separate from the card 412 for security purposes. The personal identifying indicia 414 is concealed by the rear panel 410*b* of the package when the panel 410*c* is folded between the front panel 410*a* and rear panel 410*b* into a configuration similar to that shown in FIG. 6. Further concealment can be optionally provided by a scratch-off surface over the indicia 414. As in the previous embodiments, the account verification indicia 16 on the card 412 is visibly exposed through an aperture 18 in the face of the rear panel 410*b*, while the account verification indicia 16*a* is likewise visibly exposed on the same face of the panel 410*b*.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A data package assembly comprising:

(a) at least one data card having a first substrate with opposite faces, said card having indicia correlated with a prepaid account;

(b) a package having a second substrate separate from said first substrate, said second substrate comprising at least a pair of panels folded together so as to contain said data card between said panels;

(c) personal identifying indicia correlated with said account and concealed by said package;

(d) first account verification indicia on said data card and second account verification indicia on said package, both different from said personal identifying indicia and both correlated with said account, said first and second account verification indicia both being visibly exposed, said package including an aperture visibly exposing at least said first account verification indicia.

2. The data package assembly of claim 1 wherein said package includes an aperture visibly exposing a major portion of at least one of said faces of said data card.

3. The data package assembly of claim 1 wherein said package has opposite faces, one of said faces of said package visibly exposing both said first and second account verification indicia.

4. The data package assembly of claim 1, said package having said personal identifying indicia separate from said data card.

5. The data package assembly of claim 4 wherein said personal identifying indicia are on a detachable portion of said second substrate.

6. The data package assembly of claim 4 wherein said personal identifying indicia are excluded from said data card.

* * * * *

UNITED STATES PATENT AND TRADEMARK OFFICE

CERTIFICATE OF CORRECTION

PATENT NO. : 6,439,613 B2
DATED : August 27, 2002
INVENTOR(S) : Brian Klure

It is certified that error appears in the above-identified patent and that said Letters Patent is hereby corrected as shown below:

Column 4,
Line 14, change "rear panel 10b" to -- rear panel 110b --.

Signed and Sealed this

Twenty-third Day of September, 2003

JAMES E. ROGAN
*Director of the United States Patent and Trademark Office*